US012433346B2

(12) United States Patent
Adair

(10) Patent No.: US 12,433,346 B2
(45) Date of Patent: Oct. 7, 2025

(54) ELECTRONIC CIGARETTE WITH NEAR FIELD COMMUNICATION

(71) Applicant: JT International SA, Geneva (CH)

(72) Inventor: Kyle Adair, Lisburn (GB)

(73) Assignee: JT International SA (CH)

( * ) Notice: Subject to any disclaimer, the term of this patent is extended or adjusted under 35 U.S.C. 154(b) by 567 days.

(21) Appl. No.: 17/779,858

(22) PCT Filed: Nov. 27, 2020

(86) PCT No.: PCT/EP2020/083741

§ 371 (c)(1),
(2) Date: May 25, 2022

(87) PCT Pub. No.: WO2021/105432

PCT Pub. Date: Jun. 3, 2021

(65) Prior Publication Data

US 2022/0400775 A1 Dec. 22, 2022

(30) Foreign Application Priority Data

Nov. 28, 2019 (EP) ..... 19212187

(51) Int. Cl.
*A24F 40/65* (2020.01)
*A24F 40/40* (2020.01)

(52) U.S. Cl.
CPC ..... *A24F 40/65* (2020.01); *A24F 40/40* (2020.01)

(58) Field of Classification Search
CPC ..... A24F 40/10; A24F 40/70; A24F 40/40; A24F 40/42; A24F 40/65; A61M 15/06
See application file for complete search history.

(56) References Cited

U.S. PATENT DOCUMENTS

| | | | | |
|---|---|---|---|---|
| 9,864,947 | B1 | 1/2018 | Sur et al. | |
| 9,980,514 | B2 | 5/2018 | Malamud et al. | |
| 2016/0374398 | A1 | 12/2016 | Amir | |
| 2017/0196269 | A1* | 7/2017 | Bernauer | G08B 6/00 |
| 2017/0334605 | A1* | 11/2017 | Murphy | F01N 13/1805 |
| 2021/0015158 | A1* | 1/2021 | Moloney | A24F 40/60 |
| 2021/0153562 | A1* | 5/2021 | Fishwick | A24F 40/65 |
| 2021/0227892 | A1* | 7/2021 | Leah | A24F 40/53 |

(Continued)

FOREIGN PATENT DOCUMENTS

| | | | |
|---|---|---|---|
| EP | 3131209 | A1 | 2/2017 |
| WO | 2015035689 | A1 | 3/2015 |

(Continued)

OTHER PUBLICATIONS

International Search Report for Application No. PCT/EP2020/083741 mailed Jan. 12, 2021, pp. 1-4.

*Primary Examiner* — Marcus E Harcum
(74) *Attorney, Agent, or Firm* — Lerner David LLP

(57) ABSTRACT

An electronic cigarette includes an inhaler body and a removable capsule with a base, connectable to the inhaler body. The inhaler body includes a first NFC tag and the removable capsule includes a second NCF tag, the first NFC tag and the second NFC tag being configured to exchange data when the removable capsule is connected to the inhaler body. The inhaler body includes an opening for receiving the removable capsule and at least one aperture for facilitating the electromagnetic connection between the first NFC tag and the second NFC tag.

13 Claims, 4 Drawing Sheets

(56) References Cited

U.S. PATENT DOCUMENTS

| | | | | |
|---|---|---|---|---|
| 2021/0401061 | A1* | 12/2021 | Davis | A24F 40/57 |
| 2022/0030952 | A1* | 2/2022 | Lomas | A24F 40/42 |

FOREIGN PATENT DOCUMENTS

| | | | |
|---|---|---|---|
| WO | 2017055800 | A1 | 4/2017 |
| WO | 2019162152 | A1 | 8/2019 |
| WO | 2019215213 | A1 | 11/2019 |

* cited by examiner

ELECTRONIC CIGARETTE WITH NEAR FIELD COMMUNICATION

CROSS-REFERENCE TO RELATED APPLICATIONS

The present application is a national phase entry under 35 U.S.C. § 371 of International Application No. PCT/EP2020/083741, filed Nov. 27, 2020, published in English, which claims priority to European Patent Application No. 19212187.9 filed Nov. 28, 2019, the disclosures of which are incorporated herein by reference.

FIELD OF THE INVENTION

The invention relies on an electronic cigarette (e-cigarette) with near field communication comprising an inhaler body and a removable capsule with a base, connectable to the inhaler body. The inhaler body comprises a first near field communication (NFC) tag and the capsule comprises a second near field communication (NFC) tag configured for exchanging data when the removable capsule is connected to the inhaler body.

BACKGROUND OF THE INVENTION

E-cigarettes, also known as e-cigs, vapes, vape pens, mods and tanks are devices that operate by heating a liquid solution to a high enough temperature so that it produces an aerosol that is inhaled. The liquid solution, sometimes called e-liquids or solvent, typically include nicotine, flavourings and a humectant to retain moisture and create an aerosol when heated. In general, electronic vaping devices such as e-cigarettes include an inhaler body and a removable cartridge, which may be replaced by a new cartridge containing fresh liquid solution once the liquid solution is exhausted. An e-cigarette includes a power source, accommodated in the inhaler body to provide power to a vaporizer including a heater. The vaporizer is in fluid communication with a reservoir capable of holding the liquid solution and is configured to provide the liquid solution toward the heater wherein the liquid solution is used for producing and flavouring a vapour of the electronic cigarette. The heater, the vaporizer, the reservoir are included in the removable cartridge, which can be seen as a cartomizer. In addition, a communication function may be provided in particular on the cartomizer for communicating information.

More recently, another type of e-cigarettes has become known. These e-cigarettes use a so called heat-not-burn system. Heat-not-burn systems heat up a corresponding product using a battery-powered heating system. Heating of the product generates an aerosol that can be inhaled by the user. In other aspects, they are similar to the vaping e-cigarettes described above.

Some e-cigarettes use near field communication (NFC) means to control their operation. Often, an NFC tag is placed in the inhaler body and another NFC tag is placed in the removable cartridge, so that the two NFC tags can communicate with each other and exchange data when both the inhaler body and the removable cartridge are connected with each other. Use of the NFC can be useful for controlling the compatibility between the inhaler body and the removable cartridge. In another application, the connection between the two NFC tags in the inhaler body and the removable cartridge can be used as a security trigger, so that the operation of the inhaler body cannot be activated unless the NFC in the inhaler body has received corresponding data from a NFC tag in the removable cartridge.

However, one important challenge related to communication based on NFC technology using a message and reply concept between a removable cartomizer and an inhaler body of an electronic cigarette coupled via coupling means is to allow data transfer after coupling, and this in a reliable manner. In general, metallic material in the environment of communication members has an influence on the generation of an electromagnetic field used for NFC technology (among other things). In particular, the coupling means made of metal may block electromagnetic waves such that generating of a complete loop of the electromagnetic field is affected. Therefore, data transfer between the cartomizer including a NFC tag and the inhaler body including a NFC reader may be not strong and robust enough to read data signals reliably.

To overcome this problem, it is known to generate a magnetic field whose flux density is stronger, in particular by raising the value of the current intensity or by using larger antenna. However, larger antennas necessarily increase the amount of interference and lower data signal stability. Further, antenna dimension and design are adapted to the volume for integration such that the antenna has to be very small or in a folded state if integrated in the cartomizer.

U.S. Pat. No. 9,980,514 discloses an e-vaping device comprising a replaceable cartridge or first section and a reusable fixture or second section, coupled via a threaded connection. The first section comprises one or more memory chips, which may store cartomizer information and can communicate with the second section using RF technology. Therefore, a near field communication (NFC) tag may be included in the memory chip, which may be used by or serve as the memory chip to communicate data to the second section including one or both of an NFC and RFID reader for reading information. To facilitate communication, in particular electromagnetic connection between the first NFC tag and the second NFC tag, electromagnetic compatibility (EMC) circuits are provided. The communication, in particular sending data signals from the first section to the second section, is enhanced such that the signal strength is sufficiently for circuitry in the second section to read the data signals reliably and not influenced by the low resistance of the heater configured as a heating coil.

US 2016/0374398 discloses an electric cigarette comprising a battery portion, in particular a battery enclosure and a replaceable cartomizer coupled to the battery portion, wherein metal connectors provide the coupling. When the cartomizer is connected to the battery portion and the smoking action starts, a controller is activated to read a wireless memory provided in the changeable cartridge. The reading may be performed using near field communication (NFC), wherein a controller included in the battery portion having an antenna and a transmitter/receiver, which is able to read a memory chip, using NFC technology positioned in the replaceable cartridge. No means are disclosed to overcome communication problems due to blocking of electromagnetic waves by metal components.

U.S. Pat. No. 9,864,947 discloses an aerosol delivery device with a control body and a replaceable cartridge that can be connected together. Both the control body and the cartridge may be equipped with an NFC tag such that the two NFC tags communicate to exchange data via NFC tag reader means and NFC transmitter means. For example, the cartridge may comprise a base in which the electronic components adapted to communication by wireless means are positioned. This document does not disclose means for facilitating wireless communication based on electromagnetic connection.

It remains therefore the challenge to find an improvement for the communication based on NFC technology between an inhaler body and a removable cartomizer of an e-cigarette coupled by coupling means at least partially made of metal.

SUMMARY OF THE INVENTION

The inventors of the present invention have found solutions to the above-discussed problems through a new and inventive configuration of the inhaler body such to enhance the exchange of data when a removable capsule with a base is connected to the inhaler body.

The inhaler body may be configured in tubular shape or substantially cylindrically shape extending in longitudinal direction or with any other configuration such as with rectangular or rhomboidal in cross-section and is provided to include a power source. The inhaler body may be designed as a metal tube with a closed distal end and an opening at a proximal end for receiving the removable capsule. At the proximal end portion, coupling means are provided to which the removable capsule or a cartomizer can be connected. The coupling means can be realized by different connecting mechanism such as threaded engagement, press-fit engagement, an interference fit, a magnetic engagement or the like. Coupling means, the inhaler body and the removable capsule with the base may be made at least partially of metal. In particular, for providing a magnetic connection, a base made at least partially of metal is important. However, to achieve a magnetic connection which has less impact on NFC signals, small ferrous plugs can also be provided. In a connected form of the e-cigarette, the removable capsule with the base is at least partially accommodated in and coupled to the inhaler body, such that the first NFC tag on the inhaler body and the second NFC tag on the removable capsule are positioned close to each other for near field communication.

The inhaler body comprises a first NFC tag, preferably configured as a NFC reader to send energy and data and receive data to and from a second NFC tag provided on the removable capsule. Therefore, the first NFC tag can be seen as an initiator, which sends energy and data to the second NFC tag, seen as a target to start communication and to power the second NFC tag when inhaler body and removable capsule are coupled. Once the second NFC tag has received sufficient energy and command from the first NFC tag, the NFC reader, it replies and the data transfer starts. In general, the NFC technology operates using magnetic induction such that a reader emits electric current of a predetermined value to create a magnetic field. That magnetic field is received by a similar coil in another body, for example the removable capsule, where it is turned back into electrical impulses to communicate data. These so-called passive NFC tags use energy from another NFC tag, in particular the NFC reader to encode their response.

A first aspect of the invention proposes to provide at least one an opening for receiving the removable capsule and an aperture in the inhaler body for facilitating electromagnetic connection between the inhaler body comprising a first NFC tag and the removable capsule with the base, comprising the second NFC tag when both are connected. The at least one aperture may be provided on a circumferential surface of the inhaler body, preferably in a portion of the inhaler body adjacent to the position of the first NFC tag, i.e. an NFC reader antenna. The at least one aperture, as well called a window, opens a passage for electromagnetic waves transmitted and received by the first NFC tag such that blocking in this area by metallic components is at least partially reduced. The at least one aperture can provide a gap in blocking elements, in particular metal parts such as the tubular shaped inhaler body made of metal, such that the created magnetic field can close more readily.

In an embodiment of the invention, two apertures are provided, preferably diametrically opposed to each other. According to this embodiment, on opposite sides of the inhaler body, i.e. the tubular enclosure extending in longitudinal direction for the power source, two apertures are provided on the circumferential surface of the tubular enclosure. The arrangement of two apertures in positions related to the first NFC tag, i.e. the NFC reader antenna, permits development of an electromagnetic field such that a complete electromagnetic loop between the first NFC tag and the second NFC tag on the removable capsule is provided.

According to another embodiment of the invention, the electronic cigarette comprises the at least one aperture, which is filled with a material that lets through electromagnetic waves to enhance the communication based on electromagnetic connection between the first NFC tag and the second NFC tag on the removable capsule. Even by filling in material in the at least one aperture, no extended blocking of electromagnetic waves occurs.

Preferably, the material to be filled in the at least one aperture can be transparent to visible light. Due to the at least one aperture even if filled with a transparent material a level of liquid solution stored in the removable capsule or quantity of the heat-not-burn material can be inspected. Preferably, light can shine through opposed apertures to allow better inspection of the level of liquid solution or quantity of the heat-not-burn material stored in the removable capsule.

In a further embodiment, the filling material is colourless transparent polycarbonate or other suitable material characterized by non-blocking feature of electromagnetic waves and by being transparent to visible light.

According to another embodiment of the invention, the removable capsule of the electronic cigarette comprises at least one element for attenuating the electromagnetic noise. Electromagnetic noise or electromagnetic interference (EMI) is known to affect the electromagnetic field and therefore affect the NFC connection between the first NFC tag and the second NFC tag. An electromagnetic interference can be seen as a disturbance generated for example by conduction and/or external radiation that affects the electrical circuit. Therefore, at least one element of attenuating is provided for suppressing electromagnetic noise causing interference in the electromagnetic connection. The at least one element of attenuation may be implemented in an electromagnetic noise transmission path with use of shields and/or filters as typical means. The ability of a material for electromagnetic interference shielding is determined inter alia by its absorption and reflection characteristics. In general, metal is used as EM shielding either by reflection or by absorption of incident radiation power. Among them aluminium is the most widely used but it is known that EMI signals are not completely reflected and/or absorbed by an aluminium shielding.

Preferably, the element for attenuating the electromagnetic noise according to one further embodiment of the invention is a ferrite sheet. The electromagnetic noise absorber attached to the inhaler body and/or the removable capsule comprises a ferrite sheet. For example, the at least one attenuation element may be constituted by mixing a ferrite powder into a resin material to obtain a composite which can be formed, in particular into a tubular shape which can be housed inside the inhaler body.

According to a further embodiment of the invention, the electronic cigarette comprising the inhaler body and the removable capsule with the base, wherein the base comprises a base plate which is made of a non-metallic material. According to this embodiment of the invention, the removable capsule comprises at least one ferrous plug to be connected to the inhaler body.

Furthermore, the inhaler body comprising a tubular enclosure extending in a longitudinal direction can be made of a non-metallic material. Preferably, the inhaler body can be made of glass and/or plastic.

By selecting another material instead of a metallic material for at least one element of the electronic cigarette, in particular positioned in the environment of the NFC transmitter and reader the electromagnetic interference shielding effect by absorption and/or reflection of electromagnetic waves by the metallic elements are reduced.

In a further embodiment of the electronic cigarette according to the invention, the first NFC tag is disposed over at least a half of the circumference of the inhaler body and/or that the second NFC tag is disposed over at least a half of the circumference of the removable capsule. The first NFC tag and/or the second NFC tag may be configured as foldable tags.

In order to impart the NFC to the electronic cigarette, it is a challenge to allow the NFC tags to operate normally even if the space to accommodate the NFC tags are narrow as in the inside of the inhaler body and the capsule. The space for an antenna of the NFC tag is very limited, such that size, shape and material selection is important. It is known that influencing factors on efficiency and reliability of transmission using NFC is the size and area of the coil used for antenna design included in the NFC tag. For imparting the NFC function, it is possible to increase the number of rotations of the coil forming the pattern antenna of the NFC tag. Another possibility is using a flexible, in particular foldable NFC tag, in particular a flexible antenna design which can be positioned in the inhaler body and/or capsule such that extends over at least half of the circumference.

In another aspect, the invention relates to an inhaler body for an electronic cigarette comprising a first NFC tag, configured to connect to a removable capsule comprising a second NFC tag. The first NFC tag and the second NFC tag being configured to exchange data when the removable capsule is connected to the inhaler body, wherein the inhaler body comprises an opening for receiving the removable capsule and at least one aperture for facilitating the electromagnetic connection between the first NFC tag and the second NFC tag. Furthermore, the inhaler body may made of a non-metallic material.

BRIEF DESCRIPTION OF THE DRAWINGS

For a more complete understanding of the invention and the advantages thereof, exemplary embodiments of the invention are explained in more detail in the following description with reference to the accompanying drawing figures, in which like reference characters designate like parts and in which.

DETAILED DESCRIPTION OF THE INVENTION

The drawings illustrate particular embodiments of the invention and together with the description serve to explain the principles of the invention.

Figure 1:
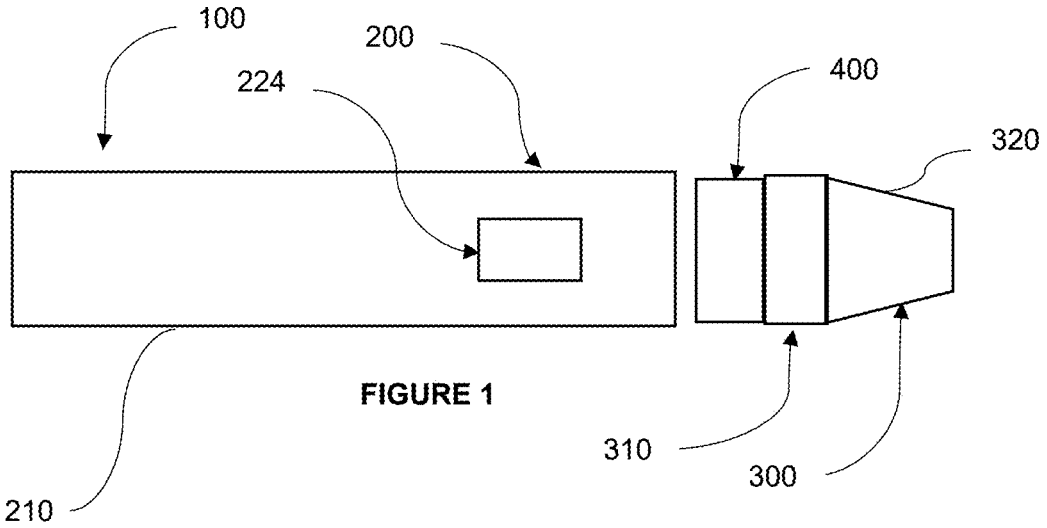
FIG. 1 shows a schematic representative of an electronic cigarette according to a first embodiment of the present invention.

FIG. 1 shows an exemplary embodiment of an electronic cigarette 100 comprising an inhaler body 200 and a removable capsule 300 with a base 400.

The inhaler body 200 has a generally elongate cylindrical enclosure 210, which encloses or houses a power source such as a battery unit (not shown) for supplying electrical power or current to an aerosol generating means (not shown) for vaporizing a liquid solution or to heat the heat-not-burn material in order to generate a vapour for inhalation. The liquid solution or the heat-not-burn material are stored in a reservoir 310, which in this embodiment is incorporated in the capsule 300. The inhaler body 200 comprises the enclosure 210 or housing and the removable capsule 300 is disposed at least partially in the enclosure 210, in particular in a chamber in which the capsule 300 is removably disposed. The chamber may be thermally isolated from the external environment. The chamber could be located at any suitable position between the distal end and the proximal end of the enclosure 210 of the inhaler body 200. The inhaler body 200 may be made of a metal such as aluminium or of a non-metallic material such as glass or plastic. The inhaler body 200 may comprise a control unit (not shown) for controlling operation of the aerosol generating means. The inhaler body 200 encloses the power source such as the battery unit (not show) which connects electrically with the control unit provided on a printed circuit board arranged in the enclosure of the inhaler body 200. It will be appreciated that in other embodiments, the aerosol generating means for vaporizing the liquid solution or for heating the heat-not-burn material to generate vapour for inhalation and/or the control unit for controlling operation of the aerosol generating means may be incorporated in the removable capsule 300.

As will be appreciated, the power source or battery unit (not shown) will typically cooperate with the control unit (not shown) or microcontroller module present in the inhaler body 200. These are operatively connected to the aerosol generating means in order to provide electric power or current to a heating element for example an inductive heating arrangement or a heating coil and to control the aerosol generating process. The control unit may be arranged to control the operation of the heating element, based on a detected characteristic, to provide a desired heating profile. The heating profile can be set automatically upon recognition of the removable capsule 300 (i.e. by reading of the data contained in the corresponding NFC tag)

so that the liquid solution as a flavour-release medium is heated in an optimum manner to release the flavour and aroma therefrom.

The removable capsule 300 includes a generally cylindrical casing or enclosure, which defines the reservoir 310 for storing a volume of the liquid solution or of the heat-not-burn material to be vaporized. A mouthpiece 320 is provided at an end of the removable capsule 300 for conveying or delivering the aerosol generated to a user. Further, the removable capsule 300 includes the base 400, which surrounds an end region. The base 400 may include coupling means (not shown) which provide a connection between the removable capsule and the inhaler body 200. The base 400 may be made of metal or a non-metallic material. For example, the inhaler body 200 including an end portion with corresponding coupling means and the removable capsule 300 can be connected by a magnetic connection, screwing or otherwise. The magnetic connection is preferable if the base 400 of the removable capsule 300 is made of metal material. According to the embodiment shown in FIG. 1, the enclosure 210 is made of a metal material and includes at least one aperture 224 such as an opening of the enclosure 210 in the form of a window.

Figure 2:
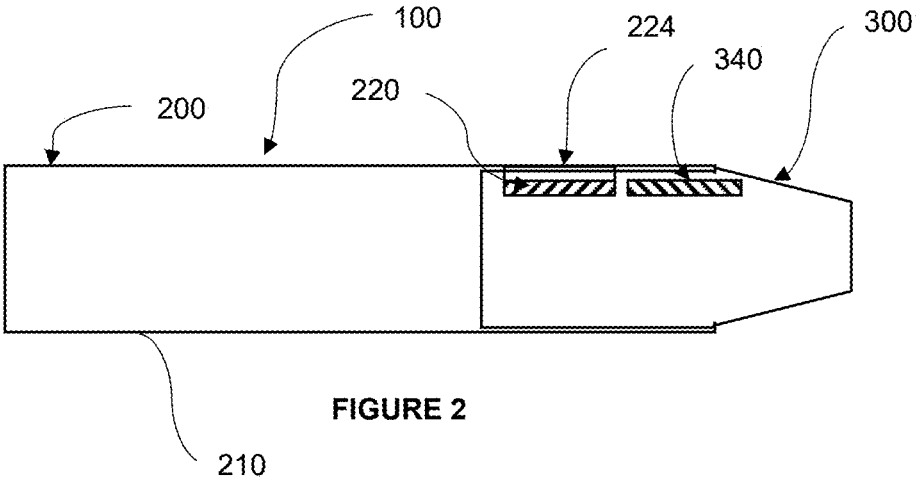
FIG. 2 shows a cross sectional view of the electronic cigarette according to the first embodiment.

In FIG. 2, the electronic cigarette 100 is shown in a cross-sectional view, wherein the inhaler body 200 includes a first near field communication (NFC) tag 220. When the inhaler body 200 and the removable capsule 300 are connected by the coupling means, the electronic cigarette 100 can be set by means in an activated state for electrically connection and activation of the aerosol generating means to generate vapour for inhalation. Further, the first NFC tag 220 is activated. The first NFC tag 220 may be provided as an active NFC tag receiving power from the power source such as the battery unit (not shown) and transmitting and/or receiving commands from and to a second NFC tag 340. The second NFC tag 340 is included on the removable capsule 300 provided for data transmission with the first NFC tag 220 on the inhaler body 200. The near field communication based on an electromagnetic field is performed between devices in close proximity, whereby the distance is related to an antenna design and dimension used in the NFC tags. The first NFC tag 220 includes inter alia a reader antenna 222 arranged in the enclosure 210 of the inhaler body 200. The reader antenna 222 can be configured as a flexible reader antenna 222. The at least one aperture 224 is arranged in relation to the first NFC tag 220, in particular to the reader antenna 222.

Figure 3:
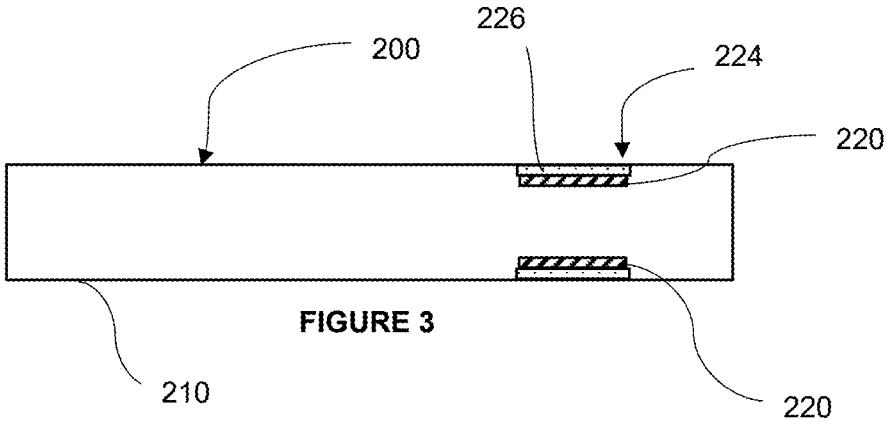
FIG. 3 shows a cross sectional view of an inhaler body of the electronic cigarette according to a second embodiment.

Shown in FIG. 3 in a cross-sectional view is the inhaler body 200 with two apertures 224 arranged on opposite sides of the enclosure 210, in particular provided on the outer circumferential surface of the tubular shape of the enclosure 210. The opposed apertures 224 are filled with a filling material 226 transparent to visible light. Light shines through the apertures 224, configured as windows, filled with the filling material 226, such that the level of the liquid solution or quantity of the heat-not-burn material stored in the reservoir 310 of the removable capsule 300 and positioned such that the reservoir 310 is in the portion of the enclosure 210 to be seen from the apertures 224 can be inspected.

Figure 4:
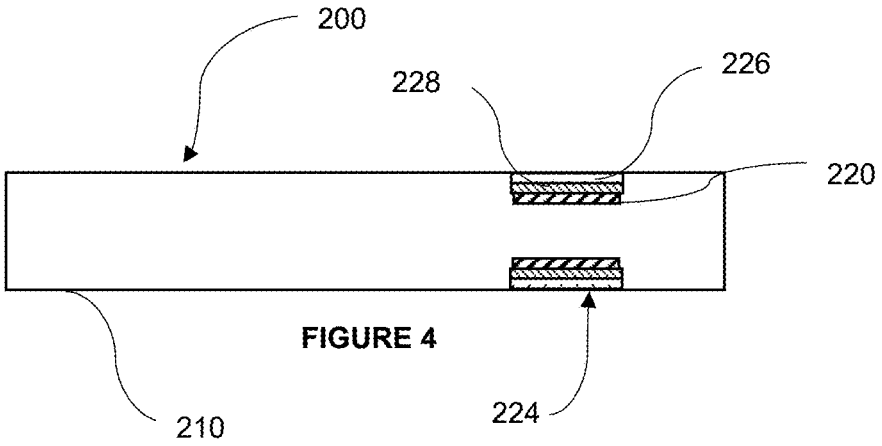
FIG. 4 shows a cross sectional view of an inhaler body of the electronic cigarette according to a third embodiment.
Figure 7:
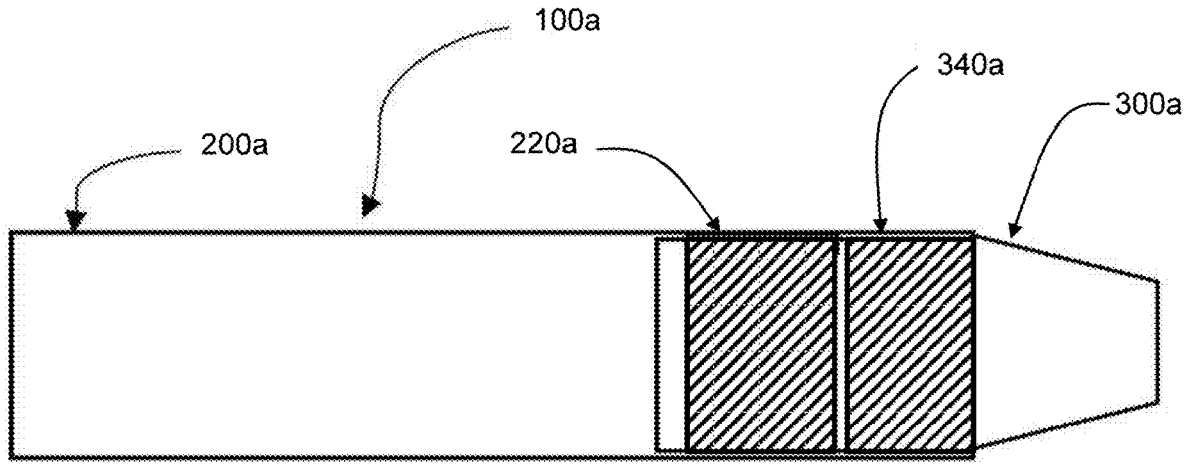
FIG. 7 shows a cross sectional view of an electronic cigarette according to another embodiment.

FIG. 4 shows another embodiment of the inhaler body 200 comprising the tubular shaped enclosure 210 opened at one end, in particular the proximal end, for receiving the removable capsule 300 and provided with two opposed apertures 224. These apertures 224 include the filling material 226 and in this portion of the enclosure 210, the first NFC tag 220 is arranged, in particular configured with a flexible antenna. Therefore, the first NFC tag 220 is disposed inside the enclosure 210 such that it extends over at least a half of the circumference of the inhaler body 200 (as shown in FIG. 7, discussed below). As can be seen in FIG. 4, between the apertures 224 and the first NFC tag 220 an element for attenuation of electromagnetic noise is arranged, provided for example as a ferrite sheet partially wrapped around on the inside of the enclosure 210 preferably made of aluminium.

Figure 5:
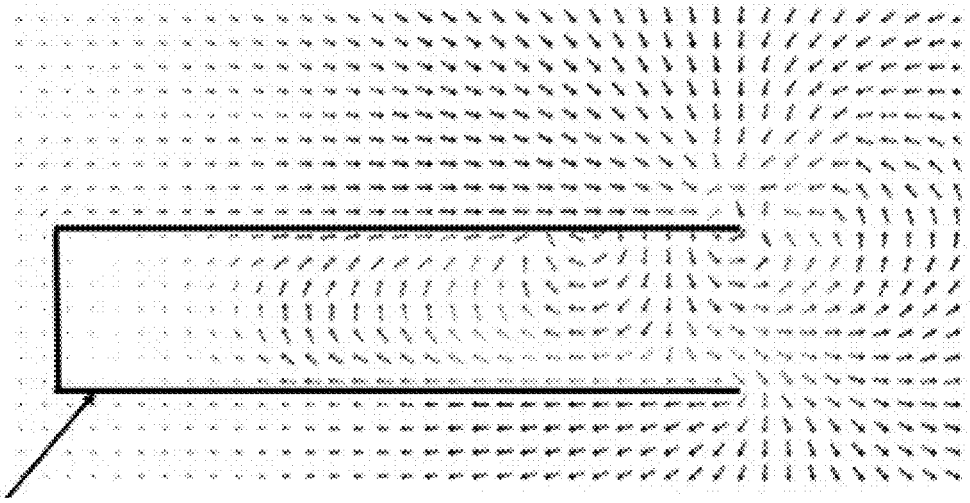
FIG. 5 shows a schematic view of vectors of a simulated magnetic field of an NFC reader antenna without an aperture in an inhaler body of an electronic cigarette.

FIG. 5 shows a simulation of a magnetic field of the first NFC tag 220 disposed inside the tubular shaped enclosure 210 which does not have any aperture 224 on the circumference of the inhaler body 200. It can be seen that the vectors of the magnetic field representing direction and magnitude of the magnetic field are such that the created magnetic field cannot close readily. Accordingly, a read range of the first NFC tag 220 is not far and/or strong enough towards the second NFC tag 340 of the removable capsule 300.

Figure 6:
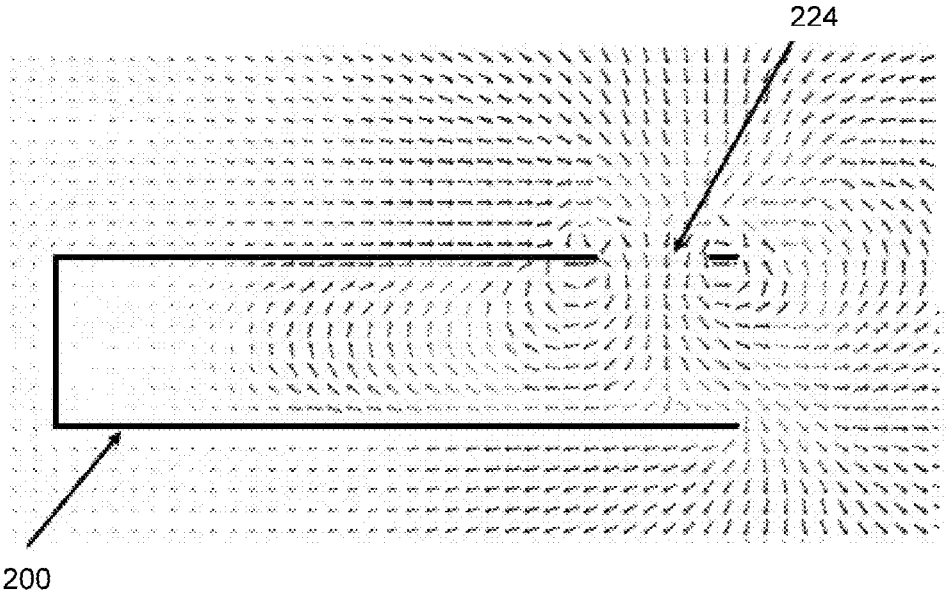
FIG. 6 shows a schematic view of vectors of a simulated magnetic field of an NFC reader antenna with an aperture in an inhaler body of an electronic cigarette.

In contrast thereto, FIG. 6 shows a simulation of a magnetic field of the first NFC tag 220 disposed inside the tubular shaped inhaler body 220 with one aperture 224 on the circumference. According to the aperture 224, the vectors of the magnetic field representing direction and magnitude of the magnetic field can develop such to create a closed magnetic field more readily.

As shown in FIG. 7, an electronic cigarette **100*a* includes a first NFC tag 220*a* disposed over at least a half of the circumference of an inhaler body 200*a*, and a second NFC tag 340*a* disposed over at least a half of the circumference of a removable capsule 300*a***.

The invention claimed is:

1. An electronic cigarette comprising an inhaler body and a removable capsule with a base, the removable capsule being connectable to the inhaler body, wherein the inhaler body comprises a first NFC tag and the removable capsule comprises a second NFC tag, the first NFC tag and the second NFC tag being configured to exchange data when the removable capsule is connected to the inhaler body, wherein the inhaler body comprises an opening for receiving the removable capsule, wherein the inhaler body comprises at least one aperture for facilitating an electromagnetic connection between the first NFC tag and the second NFC tag, and wherein the inhaler body further comprises an enclosure, the opening located at one end of said enclosure, and wherein the at least one aperture is located on a circumferential surface of the enclosure.

2. The electronic cigarette according to claim 1, wherein the at least one aperture comprises two apertures diametrically opposed to each other.

3. The electronic cigarette according to claim 1, wherein the at least one aperture is filled with a material that lets through electromagnetic waves.

4. The electronic cigarette according to claim 3, wherein the material is transparent to visible light.

5. The electronic cigarette according to claim 3, wherein the material is colourless transparent polycarbonate.

6. The electronic cigarette according to claim 1, wherein the removable capsule comprises at least one element for attenuating electromagnetic noise.

7. The electronic cigarette according to claim 6, wherein the element for attenuating electromagnetic noise is a ferrite sheet.

8. The electronic cigarette according to claim 1, wherein the base is made of a non-metallic material and the removable capsule further comprises at least one ferrous plug for connection with the inhaler body.

9. The electronic cigarette according to claim 1, wherein the inhaler body is made of a non-metallic material.

10. The electronic cigarette according to claim 9, wherein the inhaler body is made of glass and/or plastic.

11. The electronic cigarette according to claim 1, wherein the first NFC tag is disposed over at least a half of a circumference of the inhaler body and/or the second NFC tag is disposed over at least a half of a circumference of the removable capsule.

12. An inhaler body for an electronic cigarette comprising a first NFC tag, the inhaler body configured to connect to a removable capsule, the first NFC tag configured to exchange data with a second NFC tag of the removable capsule when the removable capsule is connected to the inhaler body, wherein the inhaler body further comprises an opening for receiving the removable capsule, wherein the inhaler body further comprises at least one aperture for facilitating an electromagnetic connection between the first NFC tag and the second NFC tag, and wherein the inhaler body further comprises an enclosure, the opening located at one end of said enclosure, and wherein the at least one aperture is located on a circumferential surface of the enclosure.

13. The inhaler body according to claim 12, wherein the inhaler body is made of a non-metallic material.

* * * * *